United States Patent [19]

Fukumoto

[11] Patent Number: 4,745,247

[45] Date of Patent: May 17, 1988

[54] MICROWAVE OVEN DOOR STRUCTURE

[75] Inventor: Shigeaki Fukumoto, Nara, Japan

[73] Assignee: Sharp Kabushiki Kaisha, Osaka, Japan

[21] Appl. No.: 13,973

[22] Filed: Feb. 12, 1987

[30] Foreign Application Priority Data

Feb. 19, 1986 [JP] Japan ..... 61-23675[U]

[51] Int. Cl.[4] ..... H05B 6/76

[52] U.S. Cl. ..... 219/10.55 D; 174/35 R; 126/198

[58] Field of Search ..... 219/10.55 D; 174/35 MS, 174/35 R; 126/198, 200, 190

[56] References Cited

U.S. PATENT DOCUMENTS 3,843,859 10/1974 Klemp et al. ..... 219/10.55 D 4,051,341 9/1977 Tanaka et al. ..... 219/10.55 D 4,264,880 4/1981 Jahnke et al. ..... 219/10.55 D 4,292,488 9/1981 Birk ..... 219/10.55 D 4,577,079 3/1986 Sajaku ..... 219/10.55 D

*Primary Examiner*—Philip H. Leung

*Attorney, Agent, or Firm*—Flehr, Hohbach, Test, Albritton & Herbert

[57] ABSTRACT

A microwave oven door structure has a rectangular panel with many holes therethrough formed all over its surface. Two transparent films cover it through adhesive layers from both sides. One of the films covers the panel completely but the other film covers only partially the holes near one or more peripheral regions and the adhesive layer on the same side surrounds each hole discontinuously such that air in the holes, when heated and expanding, can freely move out of the structure.

16 Claims, 1 Drawing Sheet

MICROWAVE OVEN DOOR STRUCTURE

BACKGROUND OF THE INVENTION

This invention relates to a door structure for a microwave oven and more particularly to an improved door structure for a light-weight microwave oven which is becoming popular recently.

As shown in FIG. 3, a microwave oven door of a previously developed type is comprised of a door panel 31 which closes the cooking chamber (not shown) formed in the housing (not shown), a box-shaped door screen 32 of synthetic resin covering the external surface (distal the cooking chamber) of the door panel 31 and a transparent film 33 pasted onto the internal surface (on the side of the cooking chamber) of the door panel 31. Many small holes 34 are formed in the door panel 31 such that the interior of the cooking chamber is visible from outside. These holes 34 are covered by the film 33 in an airtight manner such that the vapor generated inside the cooking chamber is prevented from invading the space between the door panel 31 and the door screen 32 and that objects like a piece of wire are prevented from entering from outside into the cooking chamber.

Another previously developed microwave oven door is shown in FIG. 4A which is a sectional view of a part thereof and FIG. 4B which is its perspective view, and comprises a door panel 41 and two transparent films 42 and 43 structured identically and pasted to both airtightly surfaces of the door panel 41. As in the previous example shown in FIG. 3, this door panel 41 is also provided with a large number of small holes 44 created by a continuous punching method which is convenient for the purpose of mass production. Numerals 45 and 46 indicate layers of an adhesive material.

The door structure as shown in FIG. 3 is relatively heavy and expensive because a molded synthetic resin product is used. The door of FIG. 4 has the advantage of being light but since the films 42 and 43 are attached to the door panel 41 such that the small holes 44 made in the door panel 41 are completely blocked, air trapped in the holes 44 by the two films 42 and 43 expands as its temperature rises by the heat from the cooking chamber. This frequently causes the films 42 and 43 to become separated from the door panel 41 and to develop wrinkles on their smooth surfaces. The external appearance of the door is thereby adversely affected and the user will feel uneasy or unsafe to use such an oven.

SUMMARY OF THE INVENTION

It is therefore an object of the present invention to provide an improved microwave oven door structure having a door panel with films pasted on both surfaces thereof such that its external appearance is not adversely affected by heat.

The above and other objects of the present invention are achieved by providing a microwave oven door structure comprising a rectangular door panel which is for closing the cooking chamber formed in the housing and formed with many small holes so that the interior of the cooking chamber can be visible from outside, a transparent film pasted on the internal surface of the door panel through an adhesive layer so as to close these small holes, and another film of the same structure pasted through another adhesive layer on the external surface of the door panel such that air inside these small holes can flow out through peripheral holes provided along at least one edge of the door panel, one of the aforementioned two adhesive layers being discontinuously formed around each of the small holes. With a door structure described above, air inside the small holes can flow out, as it expands when the cooking chamber is heated, through the gap formed between the film and the door panel because the adhesive layer on one side of the panel is discontinuously formed around the holes and by passing through the aforementioned peripheral holes which are not entirely covered by the films.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE INVENTION

Figure 1:
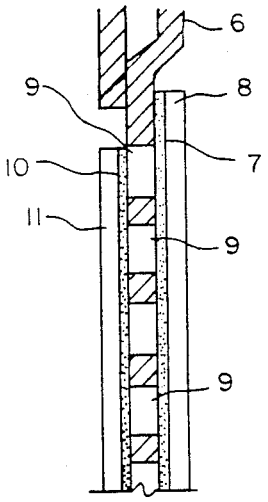
FIG. 1 is a sectional view of a peripheral part of a microwave oven door structure embodying the present invention.
Figure 2:
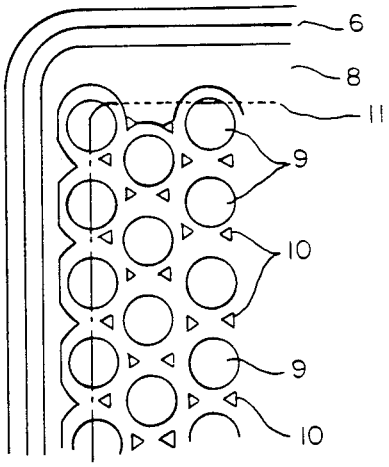
FIG. 2 is a plan view of the peripheral part of the door structure of FIG. 1.
Figure 3:
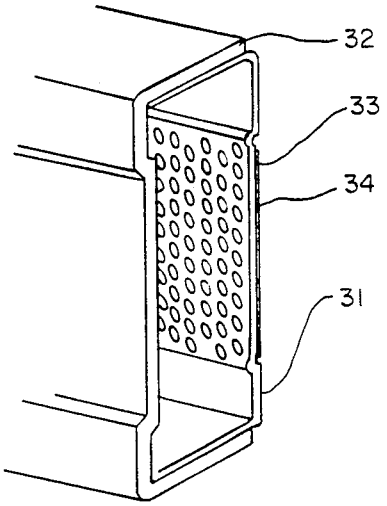
FIG. -3 (PRIOR ART)
FIG. 3 is a perspective view of a previously considered microwave oven door structure.
Figure 4A:
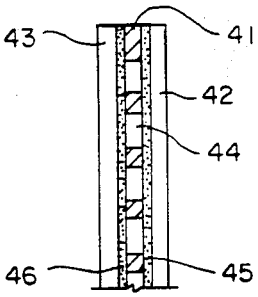
FIG. -4A (PRIOR ART)
FIGS. 4A and 4B are respectively a sectional view and a plan view of another previously considered microwave oven door structure.
Figure 4B:
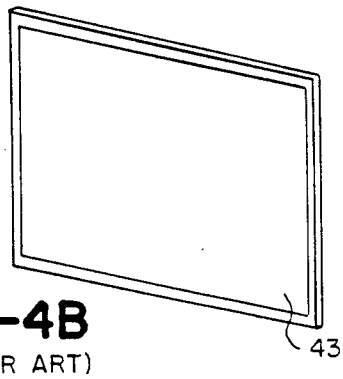
FIG.-4B (PRIOR ART)

In FIGS. 1 and 2 which are respectively a sectional view and a plan view of a peripheral part of a microwave oven door structure according to the present invention, numeral 6 indicates a generally rectangular door panel for closing the opening of a cooking chamber (not shown) in a microwave oven housing (not shown). The door panel 6 may be made of an aluminum plate, an iron plate, an electroplated steel plate or the like, and is provided with a large number of small holes 9 except near its peripheral regions. These holes 9 are for the purpose of making the interior of the cooking chamber visible from outside even when the door is closed. Of the two surfaces of the door panel 6, the one on the side of the cooking chamber when the door structure is properly installed in the microwave oven is hereinafter referred to as the internal surface and the other as the external surface.

The internal surface of the door panel 6 is entirely covered by a transparent film 8 in an air-tight manner through an adhesive layer 7 inbetween. The film 8 may comprise polyester, polyimide, polycarbonate, polyether, ether ketone or the like. The adhesive layer 7 may comprise an acryl or silicon type adhesive material. The external surface of the door panel 6 is similarly covered by another transparent film 11 through another adhesive layer 10 inbetween. The two transparent films 8 and 11 may be of the same composition and the two adhesive layers 7 and 10 may likewise be of the same material. The film 11 on the internal side of the door panel 6, however, does not cover the internal surface of the panel 6 entirely but is so designed as to only partially cover those of the holes 9 at the top edge and/or a side edge. These partially covered holes are hereinafter referred to as the peripheral holes. About 50% or somewhat less than 50% of each peripheral hole is covered by the film 11 as shown in FIG. 2. The adhesive layer 10 on the internal surface of the door panel 6 is characterized, as shown also in FIG. 2, as being formed discontinuously around each of the holes 9.

When a microwave oven door thus structured as shown in FIGS. 1 and 2 becomes warm from the heat in the cooking chamber, air inside the holes 9 expands and moves outward through the gaps between the door panel 6 and the film 11 formed because the adhesive layer 10 therebetween is discontinuous around the holes 9, escaping finally through one of the peripheral holes only partially covered by the film 11. In summary, air can expand without increasing pressure inside the holes 9 and hence the films 8 and 11 do not become wrinkly but keep their smooth appearance.

The foregoing description of a preferred embodiment of the invention has been presented for purposes of illustration and description. It is not intended to be exhaustive or to limit the invention to the precise form disclosed. For example, the adhesive layer 10 on the external surface may be formed continuously and the internal adhesive layer 7 may be formed discontinuously. Such modifications and variations that may be apparent to a person skilled in the art are intended to be included within the scope of this invention.

What is claimed is:

1. A microwave oven door structure comprising a panel having first and second surfaces opposite to each other and sides defining peripheral regions therealong, said panel being formed with a large number of holes all over said surfaces therethrough, a first transparent film entirely covering said first surface and said holes air-tightly with a first adhesive layer sandwiched between said first transparent film and said first surface with said holes, and a second transparent film nearly entirely covering said second surface and said holes with a second adhesive layer sandwiched between said second transparent film and said second surface with said holes, said second transparent film only partially covering those of said holes in one or more of said peripheral regions, said second adhesive layer surrounding said holes discontinuously so as to form air passages connecting said holes between said second surface and said second transparent film and to allow air in said holes to flow out.

2. The microwave oven door structure of claim 1 wherein said panel is generally rectangular.

3. The microwave oven door structure of claim 1 wherein said panel comprises an aluminum plate.

4. The microwave oven door structure of claim 1 wherein said panel comprises an iron plate.

5. The microwave oven door structure of claim 1 wherein said panel comprises an electroplated steel plate.

6. The microwave oven door structure of claim 1 wherein said first and second transparent films are of identical material.

7. The microwave oven door structure of claim 1 wherein said first and second transparent films comprise polyester.

8. The microwave oven door structure of claim 1 wherein said first and second transparent films comprise polyimide.

9. The microwave oven door structure of claim 1 wherein said first and second transparent films comprise polycarbonate.

10. The microwave oven door structure of claim 1 wherein said first and second transparent films comprise polyether.

11. The microwave oven door structure of claim 1 wherein said first and second transparent films comprise ether ketone.

12. The microwave oven door structure of claim 1 wherein said first and second adhesive layers comprise an acryl type adhesive material.

13. The microwave oven door structure of claim 1 wherein said first and second adhesive layers comprise an acryl type silicon material.

14. The microwave oven door structure of claim 1 wherein said second transparent film covers 50% or less of those of said holes in said one or more of said peripheral regions.

15. The microwave oven door structure of claim 1 wherein said first surface is opposite a cooking chamber of a microwave oven.

16. The microwave oven door structure of claim 1 wherein said second surface is opposite a cooking chamber of a microwave oven.

* * * * *